US006689031B2

(12) United States Patent
Nanba et al.

(10) Patent No.: US 6,689,031 B2
(45) Date of Patent: Feb. 10, 2004

(54) PAPER CUTTING APPARATUS FOR FOLDER

(75) Inventors: Takeo Nanba, Yokohama (JP); Hiroyuki Fujinuma, Kunitachi (JP); Toshio Hasegawa, Kawasaki (JP)

(73) Assignee: Tokyo Kikai Seisakusho. Ltd., Tokyo (JP)

( * ) Notice: Subject to any disclaimer, the term of this patent is extended or adjusted under 35 U.S.C. 154(b) by 0 days.

(21) Appl. No.: 10/246,043

(22) Filed: Sep. 18, 2002

(65) Prior Publication Data

US 2003/0136239 A1 Jul. 24, 2003

(30) Foreign Application Priority Data

Jan. 24, 2002 (JP) ..... 2002-014976

(51) Int. Cl.[7] ..... B31B 1/00; B31B 1/20

(52) U.S. Cl. ..... 493/22; 493/12; 493/16; 493/31; 493/324

(58) Field of Search ..... 493/12, 16, 22, 493/324; 3/63–67, 74, 75; 242/554, 554.1, 554.2

(56) References Cited

U.S. PATENT DOCUMENTS 5,279,195 A * 1/1994 Breton ..... 83/72
6,000,334 A * 12/1999 Suzuki ..... 101/227
6,440,049 B1 * 8/2002 Belanger et al. ..... 493/14
6,554,266 B2 * 4/2003 Nanba et al. ..... 270/47

* cited by examiner

*Primary Examiner*—Rinaldi I. Rada
*Assistant Examiner*—Hermant M Desai
(74) *Attorney, Agent, or Firm*—McGlew and Tuttle, P.C.

(57) ABSTRACT

There is provided a paper cutting apparatus for a folder, the folder for a web rotary press being provided with a forming roller pair and at least one nipping roller pair on a downstream side of the forming roller pair in a paper passage between a former and a folding cylinder group, and provided with a paper jam detector S for detecting an occurrence of a paper jam at least in the folding cylinder group, including a first cutter A provided so as to be capable of cutting a paper 1 running between the forming roller pair under the former and a nipping roller pair just on the downstream side of the forming roller pair; a second cutter B provided so as to be capable of cutting the paper running between the folding cylinder group and the nipping roller pair just on the upstream side of the folding cylinder group; and control unit D which receives a paper jam signal generated from the paper jam detector S and sends a cutting signal to the first cutter A and the second cutter B.

10 Claims, 8 Drawing Sheets

PAPER CUTTING APPARATUS FOR FOLDER

BACKGROUND OF THE INVENTION

1. Field of the Invention

The present invention relates to a paper cutting apparatus for a folder, in which in the folder for a web rotary press, when a paper jam occurs on a downstream side of a folding cylinder group, a paper is cut on an upstream side of the folding cylinder group.

2. Description of the Related Art

A folder for a web rotary press includes a former for folding double a continuous paper having passed through a printing section in a widthwise direction, a pair of forming rollers arranged on a downstream side of the former, at least a pair of nipping rollers arranged on a downstream side of the paired forming rollers, and a folding cylinder group arranged on a downstream side of the paired nipping rollers. Also, in order to decrease a contact friction between a former surface and a continuous paper, the folder is constructed so as to have an air blowout port for blowing out air from the former surface.

On the other hand, the folder is provided with a paper jam detector for detecting an occurrence of paper jam on a downstream side of the folding cylinder group. A paper cutting apparatus is provided to cut the paper at a position between the former and the folding cylinder group in the event of the occurrence of paper jam. The technologies for this paper cutting apparatus have been disclosed in Japanese Utility Model Publication No. 55-32744 and Japanese Patent Laid-Open No. 2000-118862.

The technology disclosed in Japanese Utility Model Publication No. 55-32744 will be as described below. The paper cutting apparatus is provided to cut the paper in a paper passage between the paired forming rollers provided under the former of the folder and the paired nipping rollers provided just on the downstream side of the forming rollers. By a paper jam signal sent from the paper jam detector for detecting the occurrence of paper jam in a fan or a conveyor under the folding cylinder group, the paper cutting apparatus cuts the paper and blocks the paper passage to stop the advance of the succeeding paper. The succeeding paper does not enter the machine on the downstream side of the paired forming rollers, but is discharged from the former portion to the outside of the machine.

The technology disclosed in Japanese Patent Laid-Open No. 2000-118862 will be as described below. The paper cutting apparatus is provided to cut the paper in a paper passage between the folding cylinder group of the folder and the paired nipping rollers just on the upstream side of the folding cylinder group. By a paper jam signal sent from the paper jam detector for detecting the occurrence of paper jam in the folding cylinder group, the paper cutting apparatus cuts the paper and blocks the paper passage to stop the advance of the succeeding paper. The succeeding paper does not enter the folding cylinder group, but is discharged to a region deviating from there.

The above-described paper cutting apparatuses of the prior art have the problems as described below.

In the paper cutting apparatus disclosed in Japanese Utility Model Publication No. 55-32744, the preceding paper of the paper having been cut by the paper cutting apparatus, that is, the preceding paper at a distance between the paper cutting apparatus provided on the downstream side near the former and the folding cylinder group enters a portion where the paper jam has occurred before the machine is stopped. Therefore, the paper jam expands accordingly, which may cause a trouble such as damage to the machine.

In the paper cutting apparatus disclosed in Japanese Patent Laid-Open No. 2000-118862, the succeeding paper of the paper having been cut by the paper cutting apparatus provided on the upstream side near the folding cylinder group is discharged to a region at the side of the folding cylinder group.

However, the paired nipping rollers and the folding cylinder group provided on the downstream side of the paired forming rollers are generally surrounded by a cover to ensure safety and insulate sounds. Therefore, the inside of the cover of machine becomes full with a large amount of succeeding paper during the time from the operation of machine at a high speed to the emergency stop in response to the detection of the occurrence of paper jam by the paper jam detector, which may cause a trouble such as damage to the machine due to the stay of paper.

Also, the restoring work against paper jam in the paper jam portion for restarting the machine and the removing work for removing the paper filling within the cover require much time and labor, so that these kinds of work impose a burden on the worker.

SUMMARY OF THE INVENTION

An object of the present invention is to provide a paper cutting apparatus for a folder, in which when a paper jam occurs in a folding cylinder group and/or a portion on the downstream side of the folding cylinder group, a paper is cut compulsorily on the upstream side of the folding cylinder group, and the expansion of paper jam caused by the succeeding paper is restrained.

Another object of the present invention is to provide a paper cutting apparatus for a folder, which can easily discharge a cut paper to the outside of the machine.

Still another object of the present invention is to provide cutting means of a mechanism for compulsorily cutting a paper to restrain the expansion of paper jam caused by the succeeding paper when a paper jam occurs in a folding cylinder group and/or a portion on the downstream side of the folding cylinder group.

Still another object of the present invention is to provide a mechanism for easily restraining a flapping behavior of a running paper.

According to the disclosed embodiment, in a folder for a web rotary press which is provided with a forming roller pair and at least one nipping roller pair on the downstream side of the forming roller pair in a paper passage between a former and a folding cylinder group and provided with a paper jam detector for detecting the occurrence of a paper jam at least in the folding cylinder group, a paper cutting apparatus includes first cutting means provided so as to be capable of cutting a paper running between the forming roller pair under the former and the nipping roller pair just on the downstream side of the forming roller pair; second cutting means provided so as to be capable of cutting the paper running between the folding cylinder group and the nipping roller pair just on the upstream side of the folding cylinder group; and control means which receives a paper jam signal generated from the paper jam detector and sends a cutting signal to the first cutting means and the second cutting means.

DETAILED DESCRIPTION OF THE PREFERRED EMBODIMENTS

A paper cutting apparatus for a folder in accordance with an embodiment of the present invention will now be described with reference to the accompanying drawings.

Figure 1:
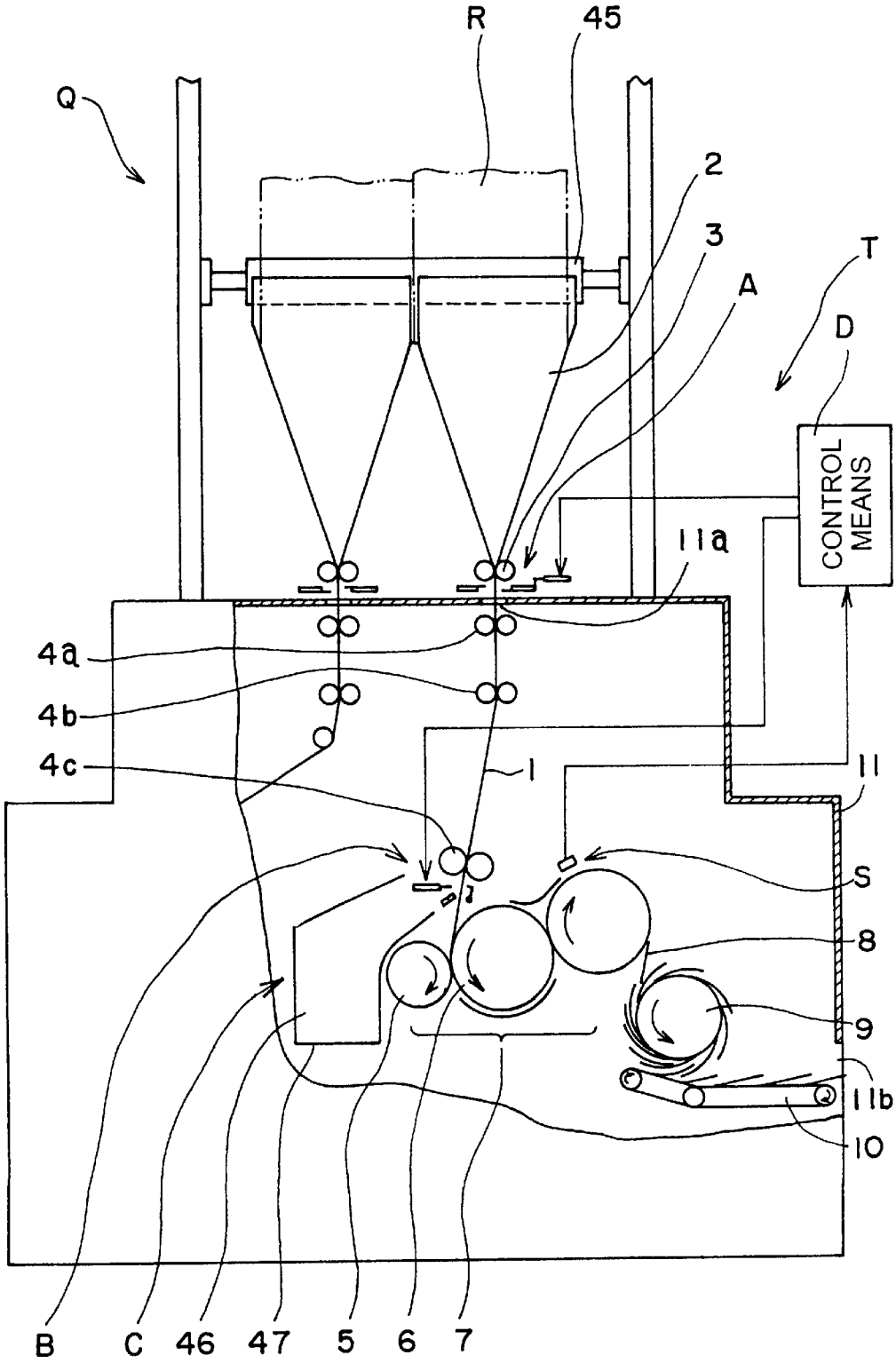
FIG. 1 is a schematic configuration view of a paper cutting apparatus for a folder in accordance with an embodiment of the present invention.

As shown in FIG. 1, in a folder Q for a web rotary press, a continuous paper R having passed through a printing section (not shown) is sent to a former 2 via a drag roller 45 and is folded double longitudinally into a paper 1 by the former 2 and a forming roller pair 3, and the folded paper 1 is held between a plurality of nipping roller pairs 4*a*, 4*b* and 4*c* and pulled by them, being sent to a folding cylinder group 7 consisting of a sawing cylinder 5, a folding cylinder 6, etc. Then, the paper 1 is cut into a predetermined length and is turned to a fold section 8 folded in four. After the fold sections 8 are dropped onto a fan 9 provided on a downstream of the folding cylinder group 7, they are put successively onto a conveyor 10 from the fan 9, and are conveyed to the outside of the machine. The folding cylinder group 7 is provided with a paper jam detector S for detecting a paper jam occurring in the folding cylinder group 7.

Also, in the folder Q, the nipping roller pairs 4*a*, 4*b* and 4*c* and the folding cylinder group 7, which are provided under the forming roller pair 3, are surrounded by a cover 11 to ensure safety and insulate sounds. The cover 11 is formed with an opening 11*a* at a position of a paper passage through which the paper 1 passes, which leads from the forming roller pair 3 to the nipping roller pair 4*a*, and is formed with an opening 11*b* at a position through which the fold section 8 folded by the folding cylinder group 7 is carried out by the conveyor 10.

In the folder Q constructed as described above, the embodiment of the present invention is configured so as to include first cutting means A provided in the paper passage between the forming roller pair 3 and the nipping roller pair 4*a* to cut the paper 1, second cutting means B provided in a paper passage between the nipping roller pair 4*c* and the folding cylinder group 7 to cut the paper 1, cut paper receiving means C provided at the side of the folding cylinder group 7 to receive a cut paper 1*a* (see FIG. 8) between first cutting means A and second cutting means B, which is cut by the first cutting means A and the second cutting means B and is sent out of the nipping roller pair 4*c* just on the upstream side of the folding cylinder group 7, and control means D which receives a paper jam signal generated by detecting the occurrence of paper jam by using the paper jam detector S provided at an appropriate position and sends a cutting signal to the first cutting means A and the second cutting means B.

1. First Cutting Means A

Figure 2:
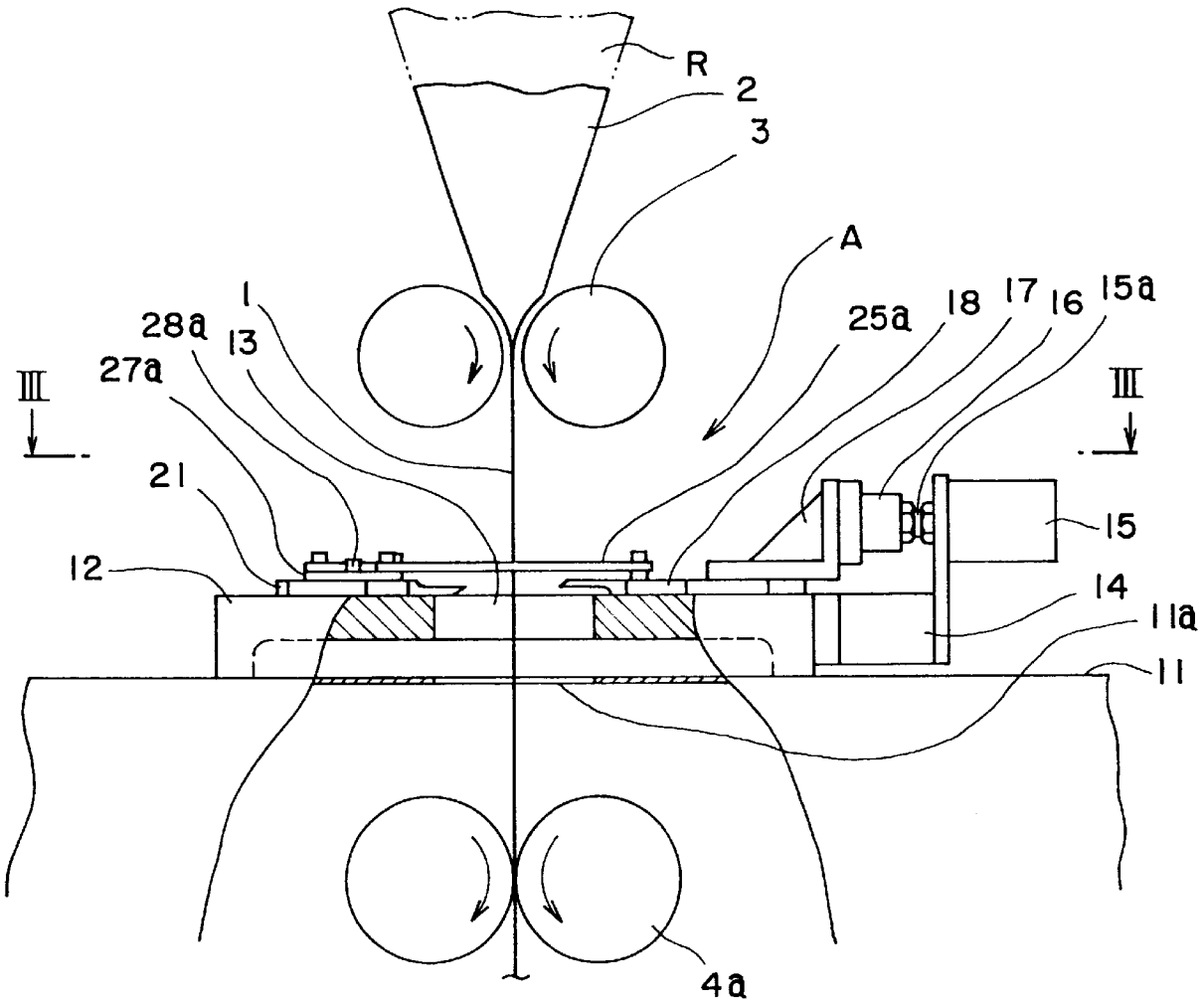
FIG. 2 is a partially enlarged sectional view of FIG. 1, showing first cutting means of the paper cutting apparatus.

The first cutting means A is provided over the opening 11*a* of the cover 11 located between the forming roller pair 3 and the nipping roller pair 4*a* as shown in FIG. 2.

First, in a base 12 installed to a machine frame, not shown, a hole 13 having a shape such that the paper 1 can pass through is formed at a position over the opening 11*a* of the cover 11. At the side parallel with the paper 1 of the base 12, a bracket 14 is provided.

On the bracket 14, a fluid pressure cylinder 15 is installed so that a tip end of a rod 15*a* thereof faces the paper 1, and at the tip end of the rod 15*a*, a bracket 17 is provided via a joint 16. This bracket 17 is connected to an upper blade 18 constituting the later-described paired cutting blades. The upper blade 18 is provided on the upper surface of the base 12 on the fluid pressure cylinder 15 side, and a lower blade 21, which constitutes the paired cutting blades, is provided on the upper surface of the base 12 on the opposite side, these blades being provided at an approximately equal distance from both sides of the paper 1 passing through the hole 13 in the base 12.

The lower blade 21 is connected to the upper blade 18 by a link mechanism so as to be operated in association with each other. Specifically, intermediate links 27, 27*a*, which are installed to the base 12 so as to be capable of being displaced angularly by pins 28, 28*a* in the central portion thereof, are arranged at both sides of the lower blade 21. At one end of the intermediate link 27, the other end of a link 25, one end of which is installed to the upper blade 18 so as to be capable of being displaced angularly, is installed so as to be capable of being displaced angularly. At the other end of the intermediate link 27, the other end of a link 30, one end of which is installed to the lower blade 21 so as to be capable of being displaced angularly, is installed so as to be capable of being displaced angularly. Similarly, at one end of the intermediate link 27*a*, the other end of a link 25*a*, one end of which is installed to the upper blade 18 so as to be capable of being displaced angularly, is installed so as to be capable of being displaced angularly, and at the other end of the intermediate link 27*a*, the other end of a link 30*a*, one end of which is installed to the lower blade 21 so as to be capable of being displaced angularly, is installed so as to be capable of being displaced angularly.

Figure 3:
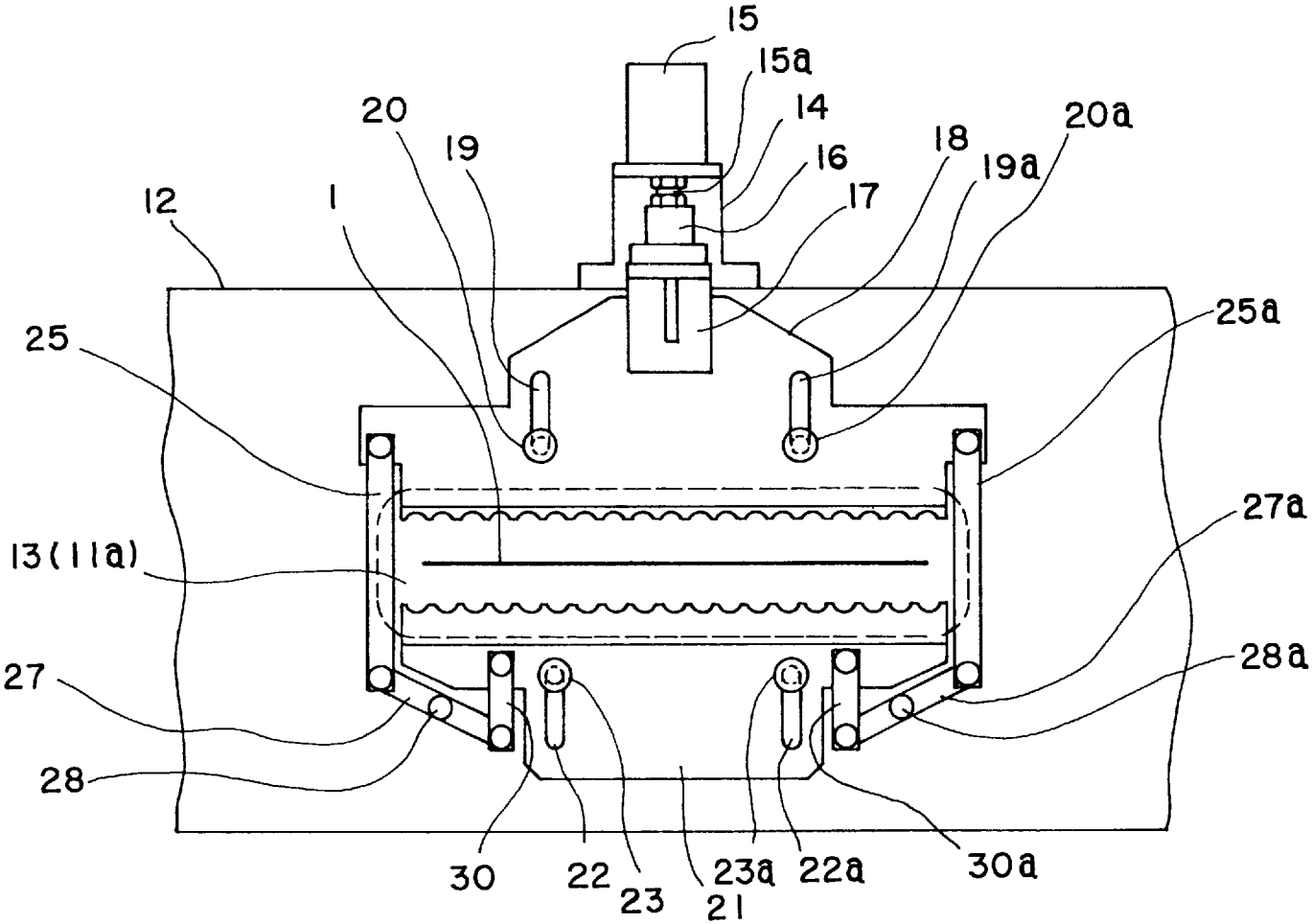
FIG. 3 is a view taken in a direction of arrows along a line III—III of FIG. 2.

Further, as shown in FIG. 3, the upper blade 18 and the lower blade 21 are provided with elongated holes 19, 19*a* and elongated holes 22, 22*a*, respectively, which are long in a direction perpendicular to the surface of the paper 1. On the side closer to the paper 1 of the elongated holes 19, 19*a* and the elongated holes 22, 22*a*, guide pins 20, 20*a* and guide pins 23, 23*a*, which are provided on the upper surface of the base 12, are inserted. Thereby, the upper blade 18 and the lower blade 21 can be moved reciprocatively in a direction perpendicular to the surface of the paper 1.

Therefore, when the rod 15*a* of the fluid pressure cylinder 15 is operated so as to be extended or contracted, the upper blade 18 and the lower blade 21 can be displaced through an equal distance in the direction opposite to each other while holding the paper 1 therebetween by the connected link mechanism. The upper blade 18 and the lower blade are lapped on each other beyond the paper passage, by which the paper 1 passing through the paper passage is cut.

2. Second Cutting Means B

Figure 4:
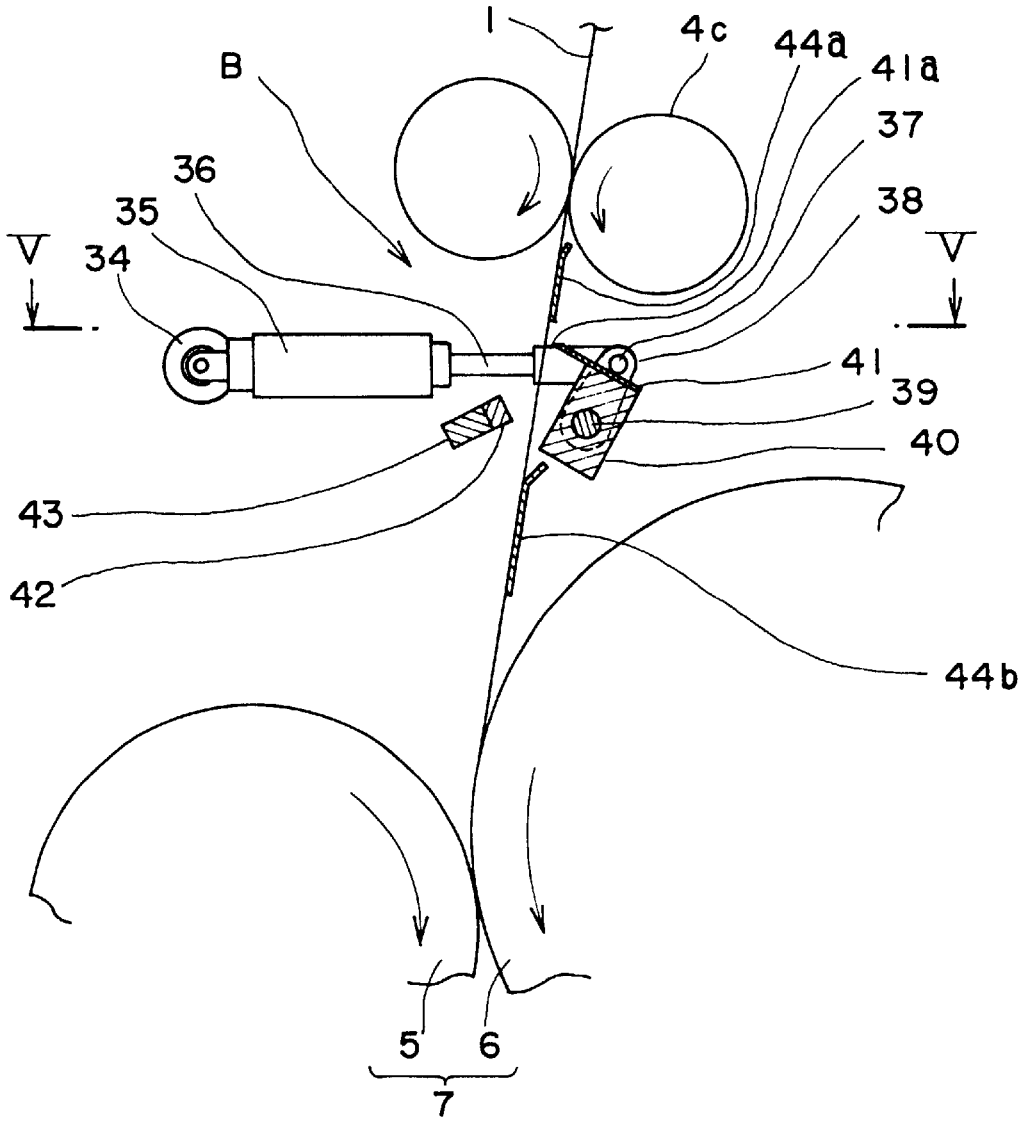
FIG. 4 is a partially enlarged sectional view of FIG. 1, showing second cutting means of the paper cutting apparatus.

The second cutting means B is provided between the nipping roller pair 4*c* and the folding cylinder group 7 as shown in FIG. 4.

Figure 5:
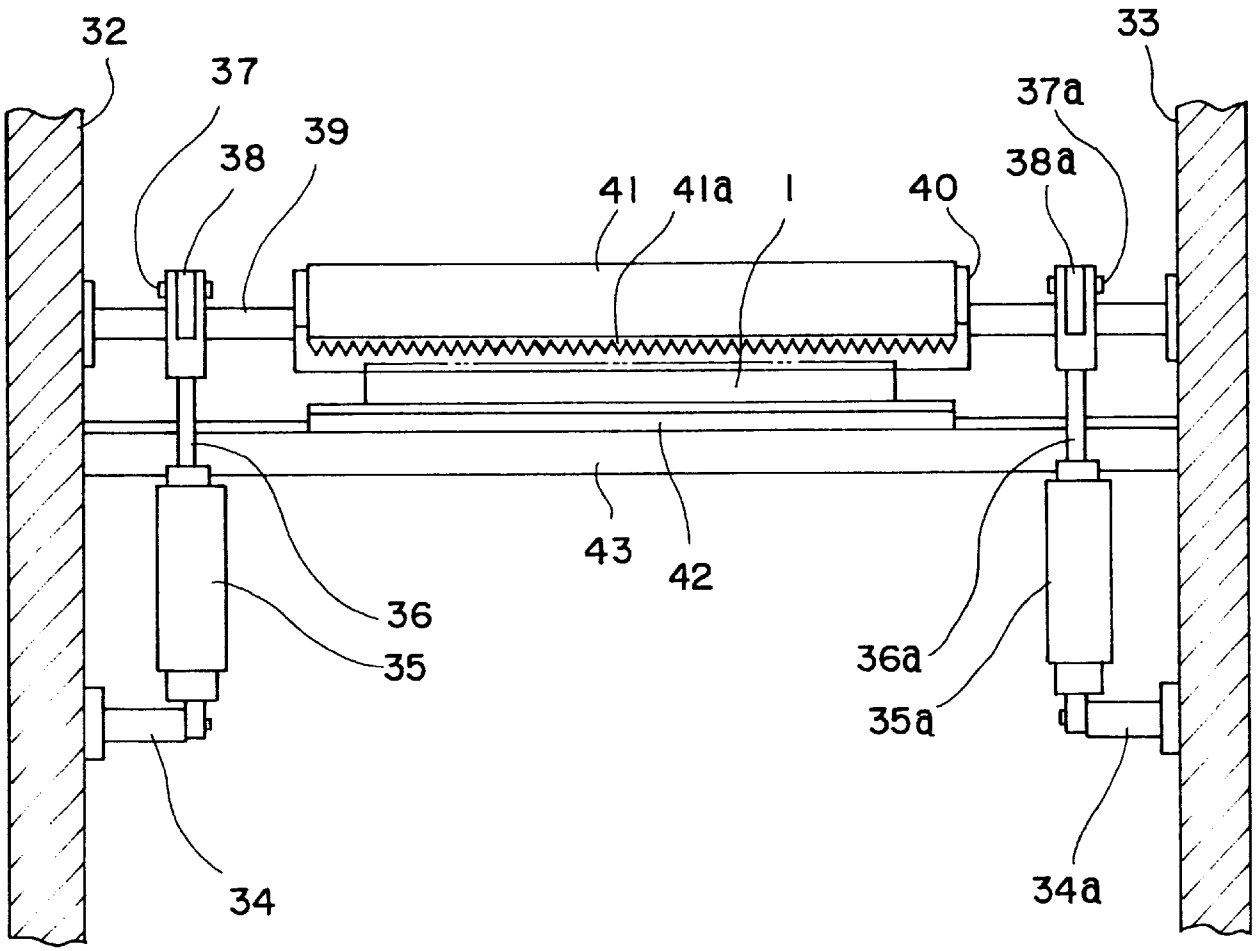
FIG. 5 is a view taken in a direction of arrows along a line V—V of FIG. 4.

Description will be given with reference to FIGS. 4 and 5. On the side of the folding cylinder 6 in the paper passage between the nipping roller pair 4*c* and the folding cylinder group 7, a shaft 39 parallel with the cylinder axis is rotatably supported on frames 32 and 33. At both sides of the shaft 39, one end portion of arms 38, 38*a* is installed so as to be integral with the shaft 39. Also, between the nipping roller pair 4*c* and the sawing cylinder 5, brackets 34, 34*a* are provided on the inside surface of the frames 32, 33, and a cylinder body of fluid pressure cylinders 35, 35*a* is installed so as to be capable of being displaced angularly. The tip end portion of rods 36, 36*a* of the fluid pressure cylinders 35, 35*a* is connected to the other end portion of the arms 38, 38*a* via pins 37, 37*a* so as to be capable of being displaced angularly.

Further, in a portion facing the paper 1 of the shaft 39, a block 40 is installed so as to be integral with the shaft 39, and on the upper surface of the block 40, a blade 41 having a width larger than the width of the paper 1 is provided. The edge facing the paper 1 of the blade 41 forms a cutting edge 41*a* which comes into contact with the paper 1 to cut it.

On the opposite side of the shaft 39 with respect to the paper 1, a stay 43 is provided between the frames 32 and 33, and a receiving block 42 is installed so as to be capable of receiving the cutting edge 41*a* when the blade 41 facing the paper 1 is displaced angularly toward the paper 1.

Also, above and below the blade 41, paper guides 44*a* and 44*b* are provided along the paper passage between the frames 32 and 33. These paper guides 44*a* and 44*b* restrain a flapping behavior of the running paper 1 and prevent the paper 1 from coming into contact with cutting edge 41*a* of the blade 41 in a standby position.

Therefore, when the rods 36, 36*a* of the fluid pressure cylinders 35, 35*a* are operated so as to be extended or contracted, the shaft 39 is displaced angularly via the arms 38, 38*a*, so that the blade 41 facing the paper 1 is displaced angularly and thus the cutting edge 41*a* reaches the receiving block 42, by which the paper is held between the cutting edge 41*a* and the receiving block 42 and is cut.

3. Cut Paper Receiving Means C

Figure 8:
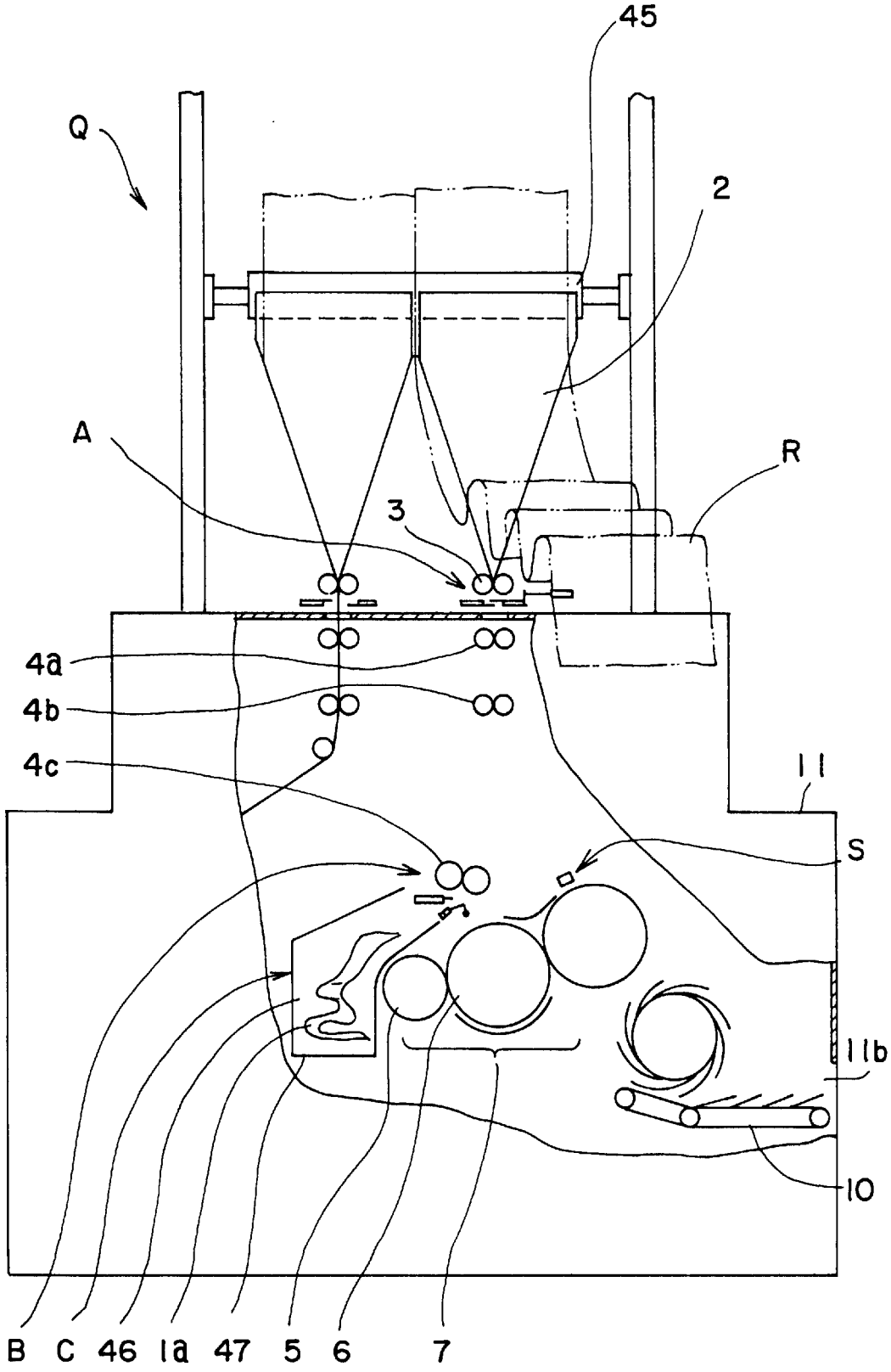
FIG. 8 is a schematic configuration view of the paper cutting apparatus for the folder in accordance with an embodiment of the present invention, showing a state after the operation of the paper cutting apparatus.

The cut paper receiving member C consists of a protector 47 which surrounds a space 46 at the side of the folding cylinder group 7 in the machine as shown in FIGS. 1 and 8. The protector 47 is provided with an introduction port for introducing the cut paper 1*a* in the vicinity of the second cutting means B, and also provided with a take-out portion for taking out the cut paper 1*a* having been introduced into the space 46 at an appropriate position.

Therefore, when the second cutting means B is operated and the cut paper 1*a* is sent out from the nipping roller pair 4*c*, the cut paper 1*a* can be introduced into the space 46 and can be removed from the space 46 by the worker after the machine is stopped.

4. Control Means D

The control means D is provided at an appropriate position in the folder Q as shown in FIG. 1. The control means D is connected to the paper jam detector S provided in the folding cylinder group 7 to detect a paper jam occurring in the folding cylinder group 7, and is also connected to the first cutting means A and the second cutting means B. The control means D is configured so that upon receipt of a paper jam signal sent from the paper jam detector S, a cutting signal can be sent to the first cutting means A and the second cutting means B.

The paper jam detector S of the folder Q may be provided at a place other than the folding cylinder group 7. For example, the detector S may be provided on the fan 9 or the conveyor 10 to detect a paper jam thereon and send a paper jam signal.

The following is a description of the operation of the paper cutting apparatus T.

(1) The first cutting means A shown in FIG. 2 is in a standby state in which the rod 15*a* of the fluid pressure cylinder 15 is retracted and the upper blade 18 and the lower blade 21 are separated from each other. The second cutting means B shown in FIG. 4 is in a standby state in which the rod 36 of the fluid pressure cylinder 35 is extended and the cutting edge 41*a* of the blade 41 is separated from the paper passage.

Also, the control means D shown in FIG. 1 is turned on when the machine is started, and is in a standby state.

In the standby state of the aforementioned means, when the continuous paper R is fed into the folder Q and the machine is operated, the continuous paper R is cut and folded into a fold section 8 and is carried out to the outside of the machine.

If a paper jam occurs in the folding cylinder group 7 and a paper jam signal is generated from the paper jam detector S that has detected the paper jam, the paper jam signal is sent to the control means D. Then, the control means D sends a cutting signal to the first cutting means A and the second cutting means B at the same time, and also sends a stopping signal for stopping the operation of the machine.

Figure 6:
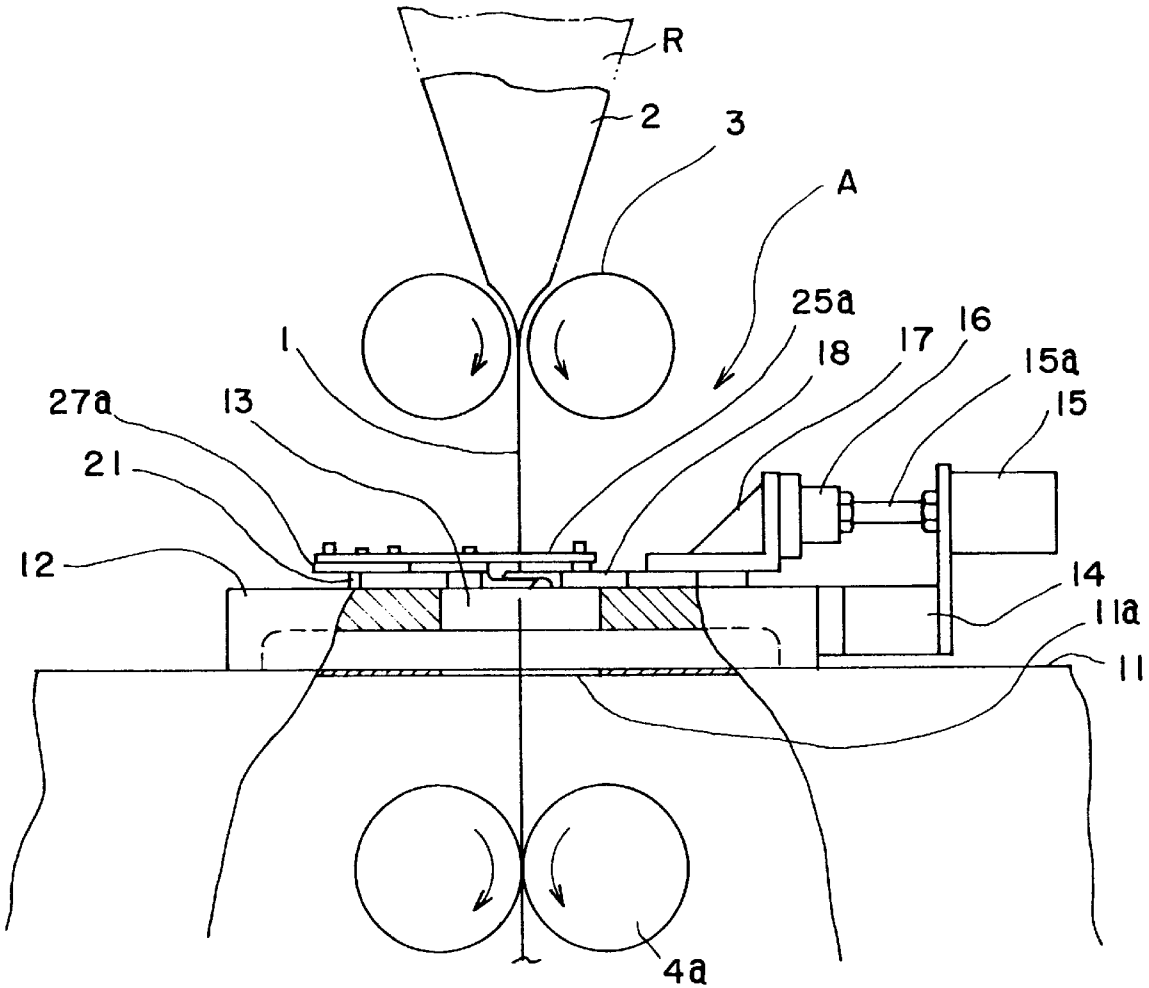
FIG. 6 is an explanatory view for illustrating an operation of the first cutting means.

(2) In the first cutting means A which has received the cutting signal sent from the control means D, a not illustrated electromagnetic valve is operated. Then, as shown in FIG. 6, the rod 15*a* of the fluid pressure cylinder 15 is extended, and moves to a position at which the tip end portions of the upper blade 18 and the lower blade 21 are lapped on each other, by which the paper 1 is cut and the paper passage is blocked.

Then, the continuous paper R to be guided by the former 2 is pushed out to the front of the former 2 by the succeeding paper. Also, in a mechanism in which an air blowout port (not shown) is provided on the surface of the former 2, the continuous paper R is pushed out to the front of the former 2 by air blown out of the air blowout port. Along with this, the paper 1 from the forming roller pair 3 to the upper blade 18 is pulled out of the forming roller pair 3, and is separated from the former 2.

The succeeding continuous paper R is discharged from the front of the former 2 to the outside of the cover 11 as shown in FIG. 8.

Figure 7:
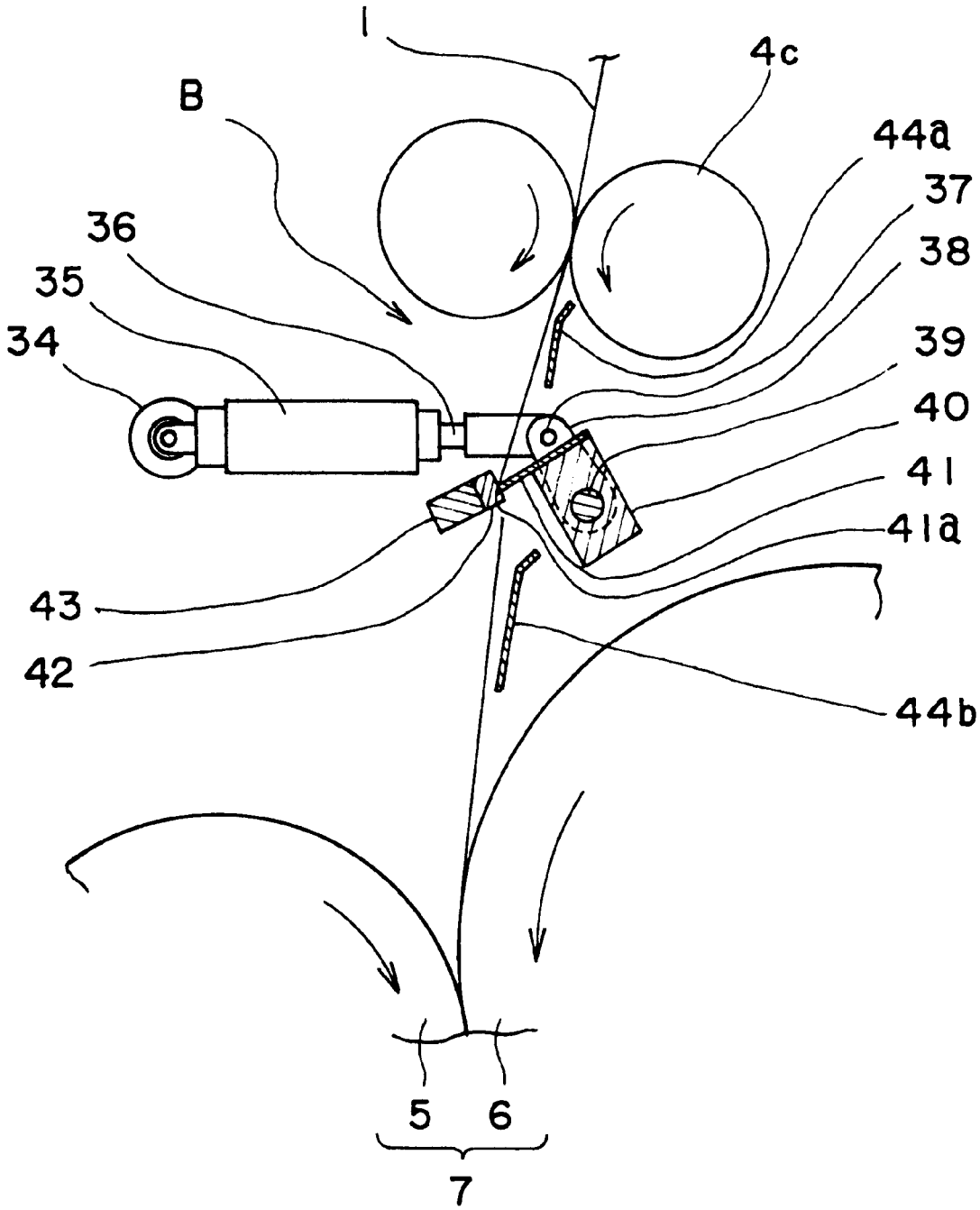
FIG. 7 is an explanatory view for illustrating an operation of the second cutting means.

(3) As in the case of the first cutting means A, in the second cutting means B, upon receipt of the cutting signal sent from the control means D, a not illustrated electromagnetic valve is operated. Then, as shown in FIG. 7, the rod 36 of the fluid pressure cylinder 35 is retreated, and the shaft 39 is displaced angularly. Thus, the blade 41 is displaced angularly and the cutting edge 41*a* comes into contact with the paper 1, by which the paper 1 is pushed on the receiving block 42 and is cut.

The cut paper 1*a* of the paper 1 from the first cutting means A to the second cutting means B is sent out to the nipping roller pair 4*c*, and is discharged into the space at the side of the sawing cylinder 5 from the second cutting means B along the paper guide 44*a* and the blade 41, being introduced into the cut paper receiving means C. In the construction in which the cut paper receiving means C is not provided, the cut paper 1*a* drops downward through the space at the side of the sawing cylinder 5.

(4) After the operation of machine has been stopped by the stopping signal, the first cutting means A and the second cutting means B return to the standby position. The restoring work against paper jam in the paper jam portion and the removing work for removing the cut paper 1*a* are performed by the worker, and then the paper feeding work for the restart of machine is performed.

In the paper cutting apparatus in accordance with the present invention, when a paper jam occurs in the folding cylinder group and/or a portion on the downstream side of the folding cylinder group, the amount of paper introduced into the cover surrounding the folding cylinder group and into the folding cylinder group can be kept to the minimum. The expansion of paper jam in the folding cylinder group can be kept to the minimum, and the inside of the cover can be prevented from becoming full with paper. Thereby, damage to the machine can be eliminated, or can be kept to the minimum.

Also, since the cut paper can be discharged easily to the outside of the machine, the worker's burden can be alleviated, and the time before performing the restoring work against paper jam in the paper jam portion by the worker and the time before the restart of the machine can be shortened.

What is claimed is:

1. A paper cutting apparatus for a folder, in which said folder for a web rotary press is provided with a forming roller pair and at least one nipping roller pair on a downstream side of said forming roller pair in a paper passage between a former and a folding cylinder group and provided with a paper jam detector for detecting an occurrence of a paper jam at least in said folding cylinder group, comprising:

first cutting means provided so as to be capable of cutting a paper running between said forming roller pair under said former and said nipping roller pair just on the downstream side of said forming roller pair;

second cutting means provided so as to be capable of cutting the paper running between said folding cylinder group and said nipping roller pair just on an upstream side of said folding cylinder group; and control means which receives a paper jam signal generated from said paper jam detector and sends a cutting signal to said first cutting means and said second cutting means.

2. The paper cutting apparatus for a folder according to claim 1, wherein said first cutting means comprises: paired upper blade and lower blade; a link mechanism for reciprocatively moving said upper and lower blades in a direction perpendicular to the surface of the running paper; and a fluid pressure cylinder for reciprocatively moving said upper and lower blades via said link mechanism; whereby the paper is cut and the paper passage is blocked at the time of paper jamming.

3. The paper cutting apparatus for a folder according to claim 1, wherein said second cutting means comprises: a shaft parallel with the axis line of said folding cylinder group, which is rotatably supported between two frames; an arm having an end portion provided integrally with said shaft at both sides of said shaft; a fluid pressure cylinder for swaying said arm around said shaft so as to be displaced angularly; a blade having a shape larger than the width of paper, which is provided on a block installed on said shaft; a cutting edge provided at the edge of the blade; and a receiving block which is provided on the opposite side of said shaft with respect to the paper to receive said cutting edge provided at the edge of said blade when said blade facing the paper is displaced angularly toward the paper; whereby when said blade facing the paper is displaced angularly by said fluid pressure cylinder and said cutting edge reaches said receiving block, the paper is held between said cutting edge and said receiving block and is cut.

4. The paper cutting apparatus for a folder according to claim 1, wherein a paper guide for restraining a flapping behavior of paper running along the paper passage is provided on the upstream side and on the downstream side near said second cutting means.

5. The paper cutting apparatus for a folder according to claim 1, wherein said paper jam detector is provided on a fan onto which a fold section that has been formed by cutting to a predetermined length and is folded drops or on a conveyor for carrying out the fold section to the outside of the machine, said fan and conveyor being provided on the downstream side of said folding cylinder group.

6. A paper cutting apparatus for a folder, in which said folder for a web rotary press is provided with a forming roller pair and at least one nipping roller pair on a downstream side of said forming roller pair in a paper passage between a former and a folding cylinder group and provided with a paper jam detector for detecting an occurrence of a paper jam at least in said folding cylinder group, comprising:

first cutting means provided so as to be capable of cutting a paper running between said forming roller pair under said former and said nipping roller pair just on the downstream side of said forming roller pair;

second cutting means provided so as to be capable of cutting the paper running between said folding cylinder group and said nipping roller pair just on an upstream side of said folding cylinder group;

cut paper receiving means for receiving a cut paper between said first cutting means and said second cutting means at the side of said folding cylinder group, said cut paper being cut by said first cutting means and said second cutting means and being sent out from said nipping roller pair just on the upstream side of said folding cylinder group; and control means which receives a paper jam signal generated from said paper jam detector and sends a cutting signal to said first cutting means and said second cutting means.

7. The paper cutting apparatus for a folder according to claim 6, wherein said first cutting means comprises: paired upper blade and lower blade; a link mechanism for reciprocatively moving said upper and lower blades in the direction perpendicular to the surface of the running paper; and a fluid pressure cylinder for reciprocatively moving said upper and lower blades via said link mechanism; whereby the paper is cut and the paper passage is blocked at the time of paper jamming.

8. The paper cutting apparatus for a folder according to claim 6, wherein said second cutting means comprises: a shaft parallel with the axis line of said folding cylinder group, which is rotatably supported between two frames; an arm having an end portion provided integrally with said shaft at both sides of said shaft; a fluid pressure cylinder for swaying said arm around said shaft so as to be displaced angularly; a blade having a shape larger than the width of paper, which is provided on a block installed on said shaft; a cutting edge provided at the edge of the blade; and a receiving block which is provided on the opposite side of said shaft with respect to the paper to receive said cutting edge provided at the edge of said blade when said blade facing the paper is displaced angularly toward the paper;

whereby when said blade facing the paper is displaced angularly by said fluid pressure cylinder and said cutting edge reaches said receiving block, the paper is held between said cutting edge and said receiving block and is cut.

9. The paper cutting apparatus for a folder according to claim 6, wherein a paper guide for restraining a flapping behavior of paper running along the paper passage is provided on the upstream side and on the downstream side near said second cutting means.

10. The paper cutting apparatus for a folder according to claim 6, wherein said paper jam detector is provided on a fan onto which a fold section that has been formed by cutting to a predetermined length and is folded drops or on a conveyor for carrying out the fold section to the outside of the machine, said fan and conveyor being provided on the downstream side of said folding cylinder group.

* * * * *